US011433689B2

(12) United States Patent
Murayama

(10) Patent No.: US 11,433,689 B2
(45) Date of Patent: Sep. 6, 2022

(54) CASSETTE AND CASSETTE BODY

(71) Applicant: BROTHER KOGYO KABUSHIKI KAISHA, Nagoya (JP)

(72) Inventor: Kentaro Murayama, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 257 days.

(21) Appl. No.: 16/453,549

(22) Filed: Jun. 26, 2019

(65) Prior Publication Data

US 2020/0094576 A1 Mar. 26, 2020

(30) Foreign Application Priority Data

Sep. 21, 2018 (JP) ..... JP2018-176821

(51) Int. Cl.

| | |
|---|---|
| ***B41J 3/38*** | (2006.01) |
| ***B41J 15/04*** | (2006.01) |
| ***B41J 32/00*** | (2006.01) |
| *B41J 31/05* | (2006.01) |
| *B41J 3/407* | (2006.01) |

(52) U.S. Cl.

CPC ..... *B41J 3/382* (2013.01); *B41J 15/044* (2013.01); *B41J 32/00* (2013.01); *B41J 3/4075* (2013.01); *B41J 31/05* (2013.01)

(58) Field of Classification Search

CPC ..... B41J 3/382; B41J 15/044; B41J 32/00; B41J 3/4075; B41J 31/05

See application file for complete search history.

(56) References Cited

U.S. PATENT DOCUMENTS

| | | | | |
|---|---|---|---|---|
| 6,042,280 | A | 3/2000 | Yamaguchi et al. | |
| 2006/0120791 | A1 | 6/2006 | Nagae et al. | |
| 2006/0188309 | A1 | 8/2006 | Akaiwa et al. | |
| 2006/0228141 | A1 | 10/2006 | Takada | |
| 2006/0245804 | A1* | 11/2006 | Yamamoto | B42C 19/06 400/62 |
| 2006/0291533 | A1* | 12/2006 | Faries | A61J 1/1462 374/E11.018 |
| 2007/0147937 | A1* | 6/2007 | Hioki | C09J 7/22 400/613 |
| 2008/0190023 | A1* | 8/2008 | Groeneweg | B65D 77/0406 47/84 |
| 2010/0166478 | A1* | 7/2010 | Yamaguchi | B41J 32/00 400/613 |

(Continued)

FOREIGN PATENT DOCUMENTS

| | | | |
|---|---|---|---|
| CN | 1798659 | A | 7/2006 |
| CN | 101758673 | A | 6/2010 |

(Continued)

OTHER PUBLICATIONS

The extended European Search Report for the related European Patent Application No. 19182578.5 dated Jul. 14, 2020.

(Continued)

*Primary Examiner* — David H Banh

(74) *Attorney, Agent, or Firm* — Kenealy Vaidya LLP

(57) ABSTRACT

A cassette includes: a housing; and a medium having a first portion contained in the housing and a second portion protruding to an outside of the housing. The second portion of the medium is a protruding portion having an indicator portion on which information is printed.

17 Claims, 13 Drawing Sheets

(56) References Cited

U.S. PATENT DOCUMENTS

| | | | | |
|---|---|---|---|---|
| 2012/0080550 | A1* | 4/2012 | Yamaguchi | B41J 11/009 242/160.4 |
| 2013/0121743 | A1 | 5/2013 | Ishii et al. | |

FOREIGN PATENT DOCUMENTS

| | | | |
|---|---|---|---|
| JP | 2003-103864 | A | 4/2003 |
| JP | 2004-26363 | A | 1/2004 |
| JP | 2006-159490 | A | 6/2006 |
| JP | 2007-190679 | A | 8/2007 |
| JP | 2013-95047 | A | 5/2013 |

OTHER PUBLICATIONS

Chinese First Office Action for the related Chinese Patent Application No. 201910565818.0 dated Apr. 6, 2022.
Japanese Office Action for the related Japanese Patent Application No. 2018-176821 dated Jun. 28, 2022.

* cited by examiner

CASSETTE AND CASSETTE BODY

CROSS REFERENCE TO RELATED APPLICATION

The present application claims priority from Japanese Patent Application No. 2018-176821, which was filed on Sep. 21, 2018, the disclosure of which is herein incorporated by reference in its entirety.

BACKGROUND

The following disclosure relates to a cassette and a cassette body including a bag containing the cassette.

A cassette that is mounted in a thermal printer for use is known. There is known a cassette of a laminate type and a cassette of a receptor type. The cassette of the laminate type contains: a transparent printing tape; an ink ribbon; and a double-sided adhesive tape including an adhesive and a release paper sheet. The cassette of the receptor type contains a printing tape to which a release paper sheet is stuck with an adhesive, instead of the printing tape and the double-sided adhesive tape contained in the cassette of the laminate type. Tape-type indicating marks are successively printed on the release paper sheet contained in the cassette of each type. Each of the tape-type indicating marks indicates information such as a type, a tape width, and the color of an ink ribbon (hereinafter referred to as "cassette information").

The cassette is mounted in a tape producing device for use. In this state, a tape-type determining sensor provided in the tape producing device reads the tape-type indicating mark. The tape producing device heats a thermal head to transfer ink of the ink ribbon to the printing tape on a condition related to the cassette information indicated by the read tape-type indicating mark. As a result, a tape for a label is produced.

SUMMARY

A seal indicating the cassette information is in some cases stuck to a surface of a housing of the cassette. The user can check the seal to recognize the cassette information. It is however desired to notify the user of the cassette information without using the seal to reduce cost, for example. Here, it is considered that the cassette information is printed on the release paper sheet to notify the user of the cassette information as in the above-described cassette. However, since the release paper sheet is contained in the housing in the cassette, the user cannot recognize the cassette information from the outside.

Accordingly, an aspect of the disclosure relates to a cassette capable of notifying a user of cassette information at low cost and a cassette body including a bag containing the cassette.

In one aspect of the disclosure, a cassette includes: a housing; and a medium including a first portion contained in the housing and a second portion protruding to an outside of the housing. The second portion of the medium is a protruding portion including an indicator portion on which information is printed.

In another aspect of the disclosure, a cassette body includes: a cassette including (i) a housing and (ii) a medium including a first portion contained in the housing and a second portion protruding to an outside of the housing, wherein the second portion of the medium is a protruding portion including an indicator portion on which information is printed; and a bag configured to cover the cassette. A portion of the bag which is opposed to the indicator portion has transparency or has a through hole.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
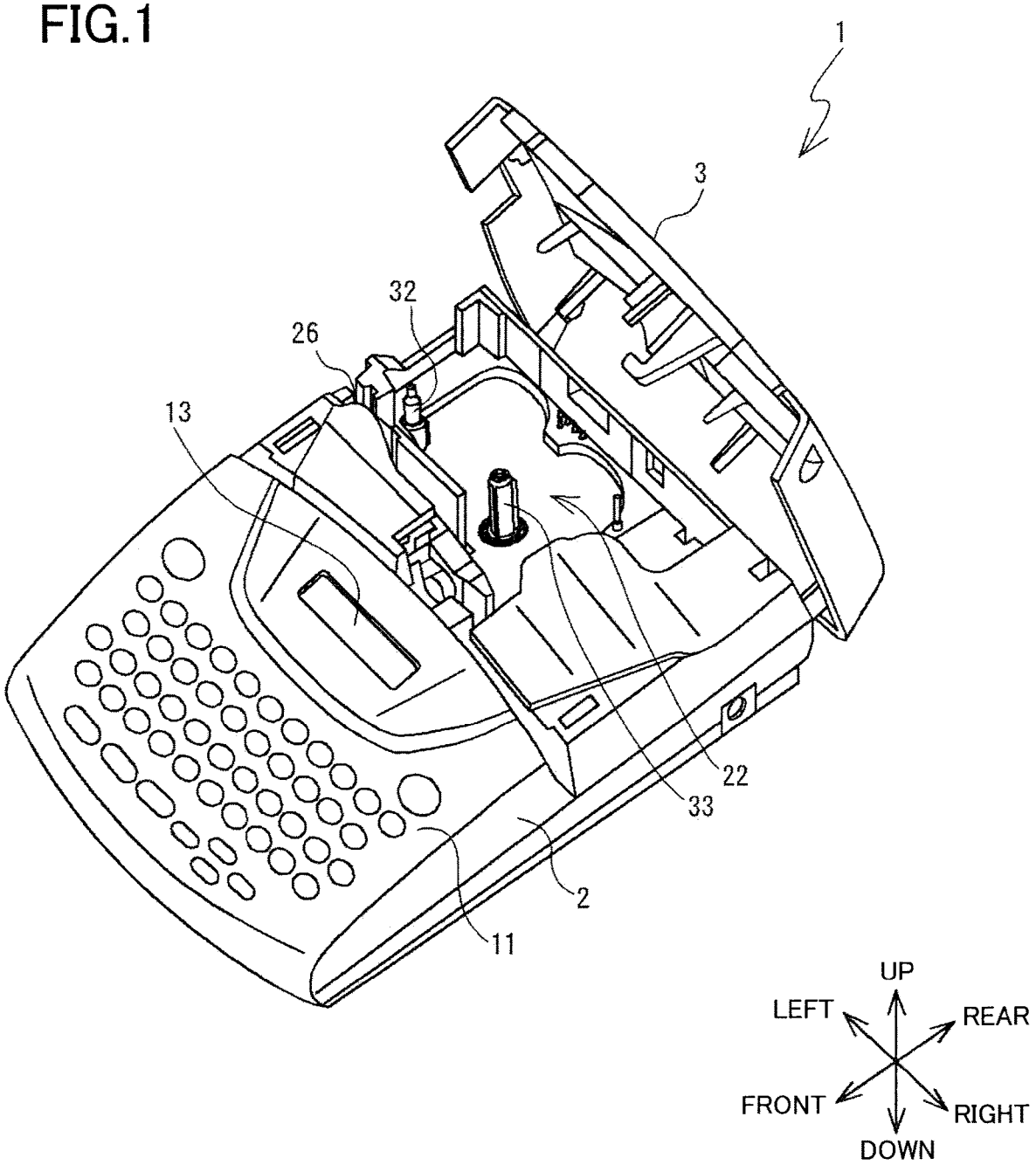
FIG. 1 is a perspective view of a printer.

Hereinafter, there will be described embodiments by reference to the drawings. The drawings are for explanation of technical features employable in the present disclosure. It is to be understood that the configuration illustrated in the drawings does not limit the present disclosure and is only one example.

Overview of Printer 1

There will be described a printer 1 with reference to FIGS. 1-3. It is noted that a gear group 90 is covered in reality in FIG. 2. In the following description, the upper side, the lower side, the lower right side, the upper left side, the lower left side, and the upper right side in FIG. 1 are defined respectively as the upper side, the lower side, the right side, the left side, the front side, and the rear side of the printer 1 and a cassette 6.

As illustrated in FIG. 1, the printer 1 is a general-type printer capable of using cassettes of various types such as a receptor type and a laminate type. As illustrated in FIG. 1, the printer 1 includes a main-body cover 2 having a substantially rectangular parallelepiped shape. An input interface 11 and a display 13 are provided on an upper surface of the main-body cover 2. The input interface 11 allows input of various kinds of information, turning on and off of a power source, and various kinds of control of the printer 1.

The display 13 displays the input information and other kinds of information. A cassette cover 3 is attached to a portion of the main-body cover 2 which is located at a rear of the display 13. The cassette cover 3 is pivotable between a closed position, not illustrated, and an open position illustrated in FIG. 1. A cassette holder 22 is provided in the main-body cover 2. The cassette 6 (see FIG. 2) is mountable in and removable from the cassette holder 22. An output opening 26 is provided to the left of the main-body cover 2. A tape 8 (see FIG. 2) having already been printed is discharged from the printer 1 via the output opening 26. It is noted that the tape 8 having already been printed may be hereinafter referred to as "printed tape".

Figure 2:
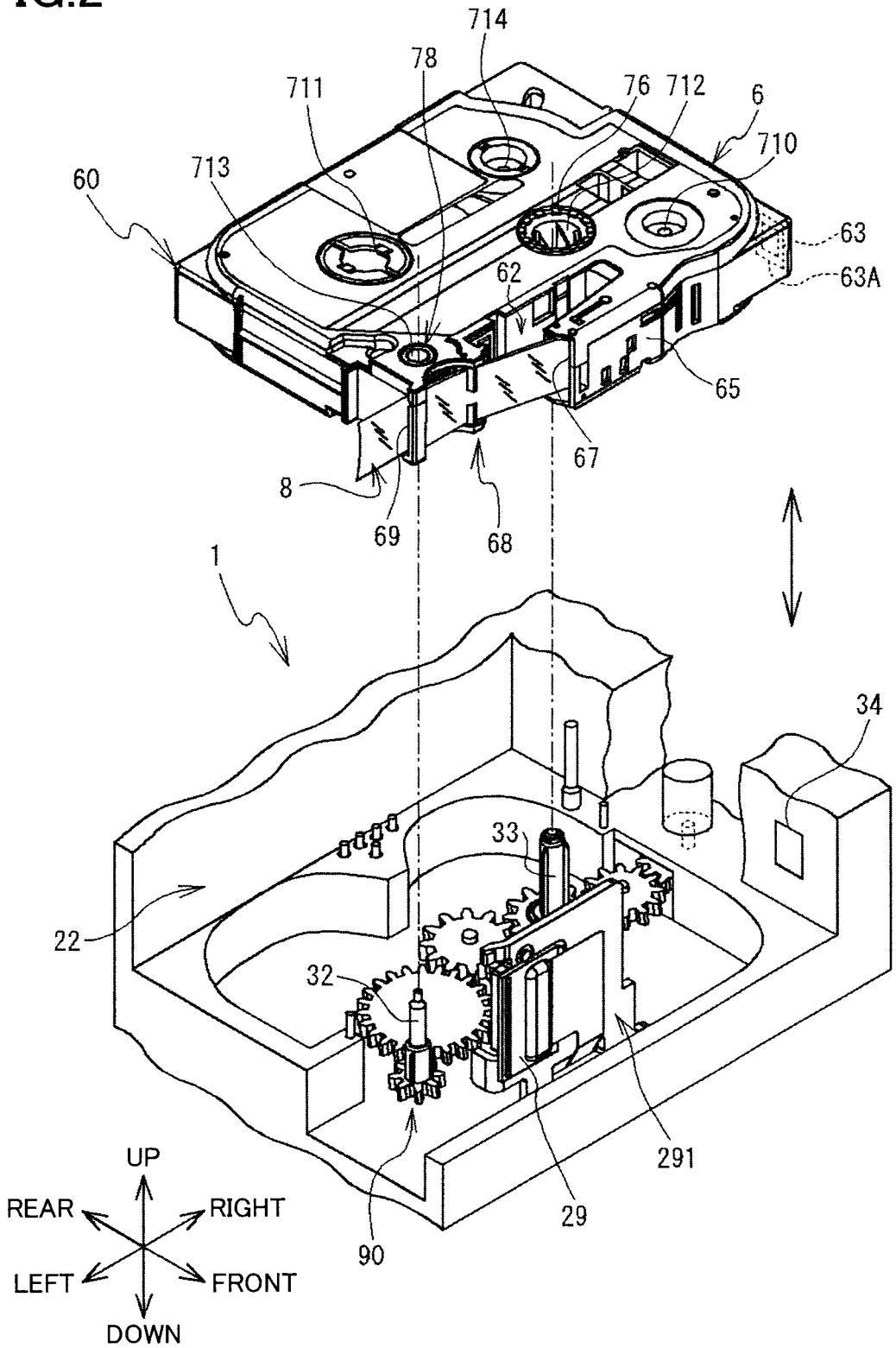
FIG. 2 is a perspective view of a cassette holder and a cassette.

As illustrated in FIG. 2, the cassette holder 22 is provided with a thermal head 29, a drive-roller shaft 32, a ribbon take-up shaft 33, an electrode 34, and a platen holder 38 (see FIG. 3), for example. The thermal head 29 is provided on a front surface of a head holder 291. The head holder 291 is provided at a front portion of the cassette holder 22. In the case where the cassette 6 is mounted on the cassette holder 22, the head holder 291 is inserted into a head inserted portion 62 of the cassette 6 (see FIG. 3). The drive-roller shaft 32 is rotatably provided to the left of the head holder 291. The ribbon take-up shaft 33 is rotatably provided at a substantially center of the cassette holder 22. The drive-roller shaft 32 and the ribbon take-up shaft 33 are coupled to each other by the gear group 90. A drive motor, not illustrated, is coupled to the gear group 90. The drive-roller shaft 32 and the ribbon take-up shaft 33 are rotated in conjunction with each other by rotation of the drive motor. The electrode 34 is provided on a right surface of the cassette holder 22. In the case where the cassette 6 is mounted on the cassette holder 22, the electrode 34 is in contact with an electrode 63 of the cassette 6.

Figure 3:
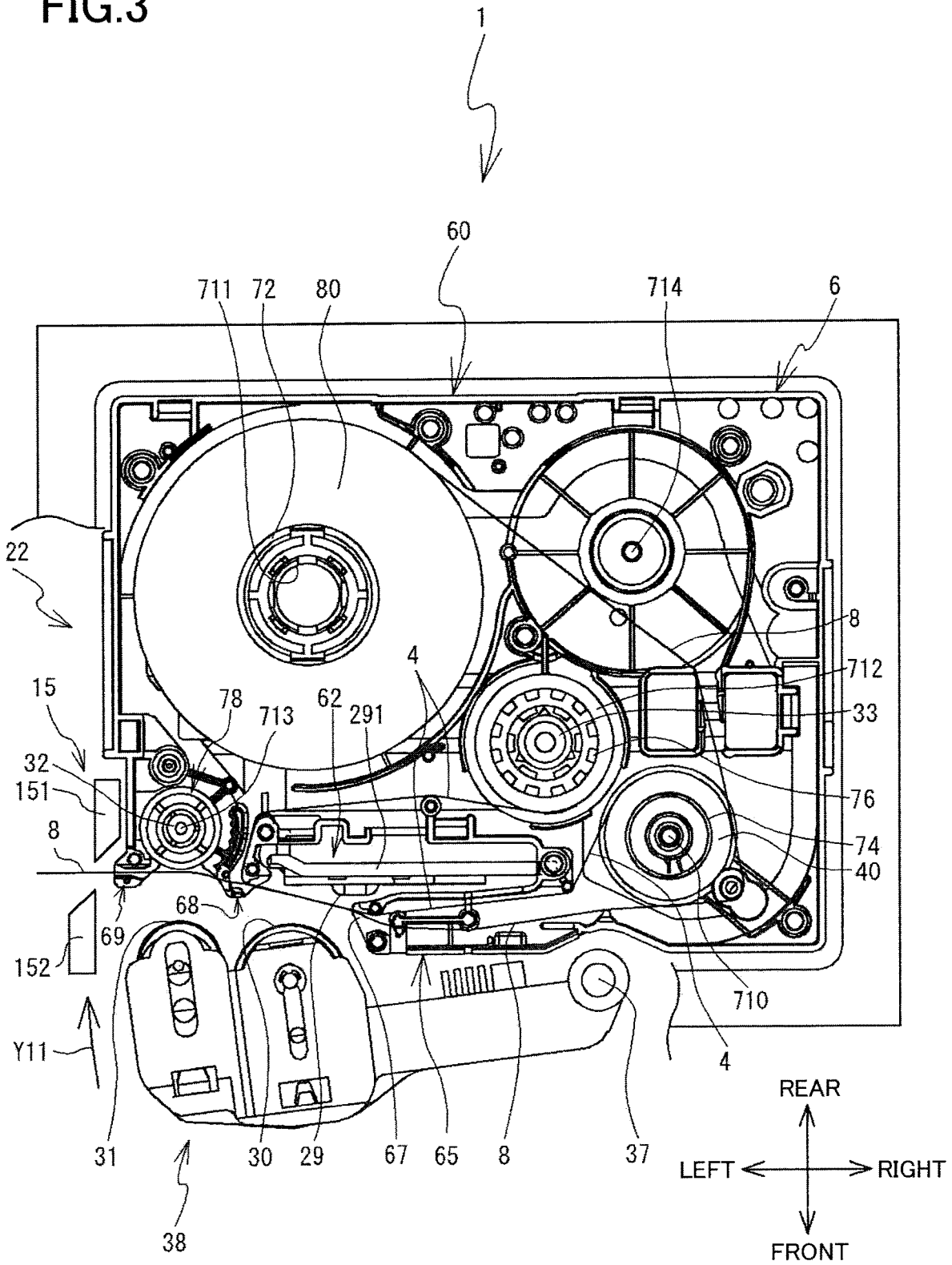
FIG. 3 is a plan view of the cassette holder holding the cassette, and a platen holder.

As illustrated in FIG. 3, the platen holder 38 is provided in front of the cassette holder 22. The platen holder 38 is supported so as to be pivotable about a pivot shaft 37 that is supported by the main-body cover 2 (see FIG. 1). The pivot shaft 37 extends in the up and down direction. The platen holder 38 supports a platen roller 30 and a tape sub-roller 31, each of which is rotatable in the counterclockwise direction in plan view. The platen roller 30 is opposed to the thermal head 29. The tape sub-roller 31 is provided to the left of the platen roller 30 and opposed to the drive-roller shaft 32. A release lever, not illustrated, is coupled to the platen holder 38. The release lever is moved in conjunction with opening and closing of the cassette cover 3 (see FIG. 1). In response to movement of the cassette cover 3 to the open position, the release lever moves the platen holder 38 to a wait position (see FIG. 3). The platen holder 38 at the wait position is spaced apart from the cassette holder 22. In response to movement of the cassette cover 3 to the closed position, the release lever moves the platen holder 38 to a printing position, not illustrated. The platen holder 38 at the printing position is located near the cassette holder 22. In this state, the platen roller 30 and the tape sub-roller 31 are located near the thermal head 29 and the drive-roller shaft 32, respectively.

A cutting mechanism 15 configured to cut the printed tape 8 is provided to the right of the output opening 26 (see FIG. 1). The cutting mechanism 15 includes a fixed blade 151 and a movable blade 152. The movable blade 152 is opposed to the fixed blade 151 and movable in the front and rear direction. The cut printed tape 8 is discharged from the printer 1 through the output opening 26.

Overview of Cassette 6

Figure 4:
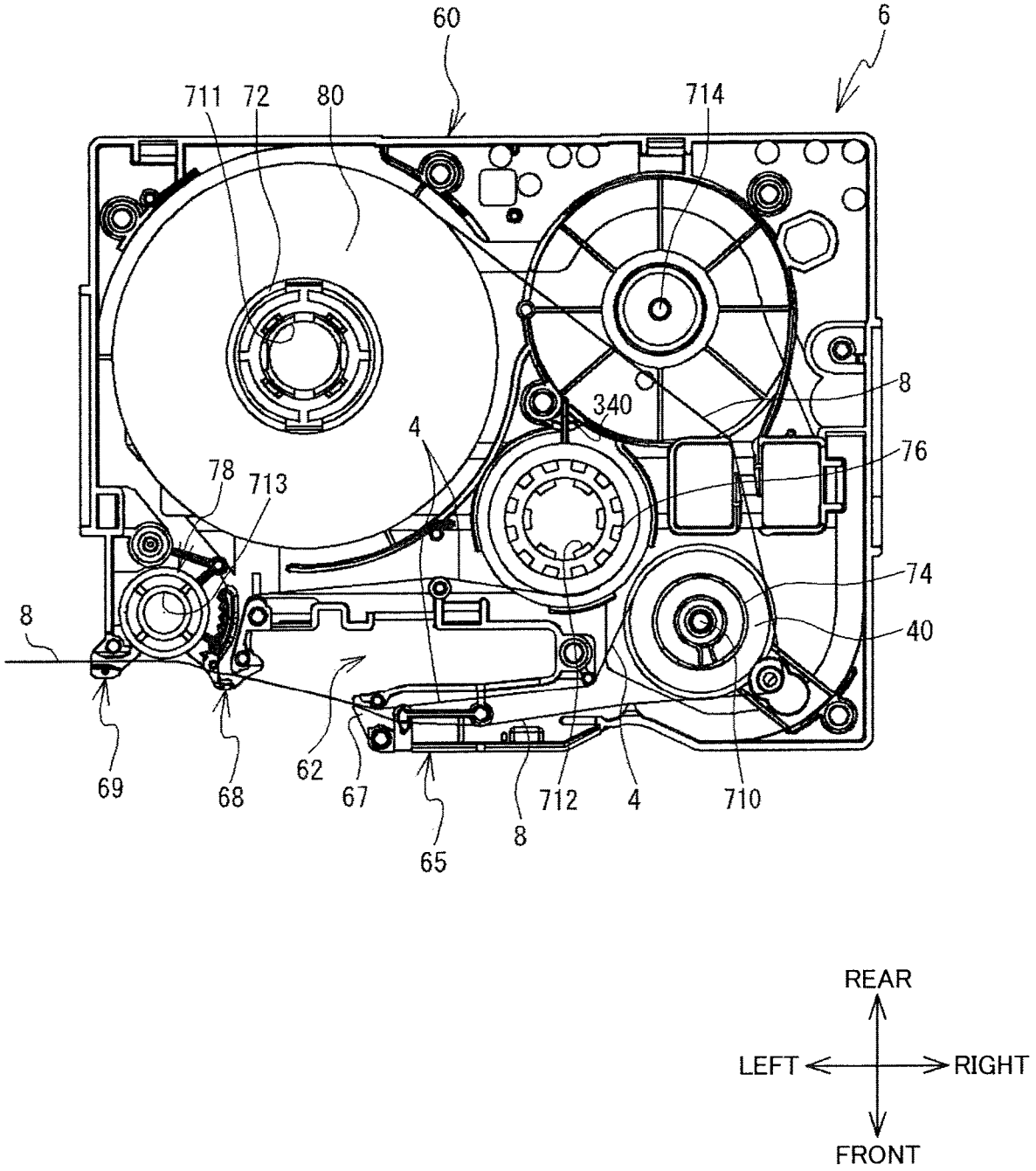
FIG. 4 is a plan view of an internal structure of the cassette.

The cassette 6 is of a receptor type. As illustrated in FIG. 4, the cassette 6 includes a housing 60. The housing 60 has a rectangular parallelepiped shape. The housing 60 contains an ink ribbon 4, the tape 8, and so on. The housing 60 has a ribbon boss 710, a support hole 711, a support hole 712, a support hole 713, and a tape boss 714.

The ribbon boss 710 is provided at a front right portion of the housing 60 to support a ribbon spool 74 such that the ribbon spool 74 is rotatable. The ribbon spool 74 holds a ribbon roll 40. The ink ribbon 4 is wound around the ribbon roll 40. The support hole 711 is located slightly at a rear of the center of the housing 60 in the front and rear direction and to the left of the center of the housing 60 in the right and left direction. A tape spool 72 is rotatably supported by the support hole 711. The tape spool 72 holds a tape roll 80. The tape 8 is wound around the tape roll 80. The tape 8 includes a substrate and a release paper sheet stuck to the substrate with adhesive. The substrate and the release paper sheet are stacked on each other.

The support hole 712 is formed between the ribbon boss 710 and the support hole 711 to support a ribbon take-up spool 76. The ribbon take-up shaft 33 (see FIG. 3) is inserted into the ribbon take-up spool 76. The ribbon take-up spool 76 is rotated by rotation of the ribbon take-up shaft 33 to draw and take up the ink ribbon 4 from the ribbon roll 40.

The support hole 713 is formed at a front left corner portion of the housing 60 to support a drive roller 78 such that the drive roller 78 is rotatable. The drive-roller shaft 32 (see FIG. 3) is inserted in the drive roller 78. The drive roller 78 is rotated by rotation of the drive-roller shaft 32 and cooperated with the tape sub-roller 31 (see FIG. 3) to draw the tape 8 from the tape roll 80 and convey it. The tape boss 714 is used in the case where the housing 60 is used for a cassette of a laminate type.

The housing 60 includes the head inserted portion 62 and an output portion 69. The head inserted portion 62 extends through a front portion of the housing 60 in the up and down direction and has a substantially U-shape in plan view. The head holder 291 (see FIG. 3) is inserted in the head inserted portion 62. The housing 60 includes an arm portion 65 located in front of the head inserted portion 62 and extending in the right and left direction. An arm opening 67 is formed in a left end portion of the arm portion 65. A ribbon separator 68 is provided at a front left corner portion of the head inserted portion 62. The ribbon separator 68 separates the ink ribbon 4 from the printed tape 8 and guides the ink ribbon 4 to the ribbon take-up spool 76. The output portion 69 is provided at the front left corner portion of the housing 60. The output portion 69 discharges the tape 8 from the cassette 6 to the outside of the cassette 6 and guides the tape 8 to the output opening 26 (see FIG. 3).

The tape 8 extends from the tape roll 80 to the arm opening 67 in the housing 60 through its front right corner portion. The ink ribbon 4 extends from the ribbon roll 40 toward the arm opening 67. In the arm opening 67, the ink ribbon 4 is placed on the substrate of the tape 8. The tape 8 and the ink ribbon 4 arranged one on another are exposed from the arm opening 67 to the outside and conveyed toward the ribbon separator 68. The ink ribbon 4 is separated from the tape 8 by the ribbon separator 68 and extends to the ribbon take-up spool 76. The tape 8 from which the ink ribbon 4 is separated by the ribbon separator 68 extends to the output portion 69.

As illustrated in FIG. 2, the electrode 63 and a storage 63A are provided on a right surface of the cassette 6. The electrode 63 is in contact with the electrode 34 of the printer 1 in the state in which the cassette 6 is mounted on the cassette holder 22 of the printer 1. The storage 63A is a non-transitory (non-volatile) memory. The storage 63A stores cassette information which will be described below.

Printing Procedure

There will be next described a printing procedure with reference to FIGS. 2 and 3. The cassette 6 is mounted on the cassette holder 22. The ribbon take-up shaft 33 and the drive-roller shaft 32 of the printer 1 are inserted respectively into the ribbon take-up spool 76 and the drive roller 78 of the cassette 6. The head holder 291 is inserted into the head inserted portion 62. The electrode 34 of the printer 1 contacts the electrode 63 of the cassette 6. This enables a controller, not illustrated, of the printer 1 to read the cassette information from the storage 63A of the cassette 6 via the electrodes 34, 63 being in contact with each other.

In response to movement of the cassette cover 3 to the closed position, the platen holder 38 is moved from the wait position to the printing position in a direction indicated by arrow Y11 in FIG. 3. The platen roller 30 presses the tape 8 and the ink ribbon 4 arranged one on another, against the thermal head 29. Heat generated by the thermal head 29 heats the ink ribbon 4. As a result, ink is transferred from the ink ribbon 4 onto the substrate of the tape 8. Information such as characters is printed in the manner described above. One of opposite surfaces of the tape 8 on which information becomes viewable by printing will be hereinafter referred to as "indicating surface". The other surface of the tape 8 will be hereinafter referred to as "non-indicating surface". In the case of the cassette 6 of the receptor type, a surface of the substrate of the tape 8 to which the ink of the ink ribbon 4 is to be transferred corresponds to the indicating surface. In the case where the release paper sheet is stuck to the substrate, one of opposite surfaces of the release paper sheet which is farther from the substrate than the other corresponds to the non-indicating surface. In the case where the release paper sheet is peeled off from the substrate, one of opposite surfaces of the substrate which is farther from the indicating surface than the other corresponds to the non-indicating surface.

As illustrated in FIG. 3, the ink ribbon 4 used for printing is separated from the printed tape 8 by the ribbon separator 68 and wrapped around the ribbon take-up spool 76. The printed tape 8 from which the ink ribbon 4 is separated is discharged from the output portion 69 to the outside of the cassette 6 by rotation of the drive roller 78. The discharged printed tape 8 is discharged to the outside of the printer 1 through the output opening 26. In the case where the input interface 11 is operated to cut the tape 8, the cutting mechanism 15 is driven to move the movable blade 152 toward the fixed blade 151 to cut the discharged tape 8.

Details of Cassette 6 (First to Sixth Embodiments)

There will be next described the cassettes 6 removed from the printer 1 with reference to FIGS. 5-10. It is noted that each of the cassettes 6 which will be described below includes not only the cassette 6 in an unused state but also the cassette 6 removed from the printer 1 after being mounted and used on the printer 1. In the cassette 6, a portion of the tape 8 is disposed on an opposite side of the output portion 69 from the tape roll 80 in a direction along a path through which the tape 8 is conveyed. Hereinafter, a side of the output portion 69 which is nearer to the tape roll 80 in the direction along the path through which the tape 8 is conveyed will be referred to as "upstream side", and a side of the output portion 69 which is farther from the tape roll 80 in the direction along the path through which the tape 8 is conveyed will be referred to as "downstream side". A portion of the housing 60 which is located upstream of the output portion 69 will be referred to as "inside of the housing 60", and a portion of the housing 60 which is located downstream of the output portion 69 will be referred to as "outside of the housing 60". A portion of the tape 8 which protrudes to the outside of the housing 60 will be referred to as "protruding portion 8P". The partially-enlarged view in each of FIGS. 5A, 7A, 8A, 9A, and 10A indicates a state in which line A-A is viewed in a direction indicated by the arrow.

First Embodiment (Cassette 6A)

Figure 5:
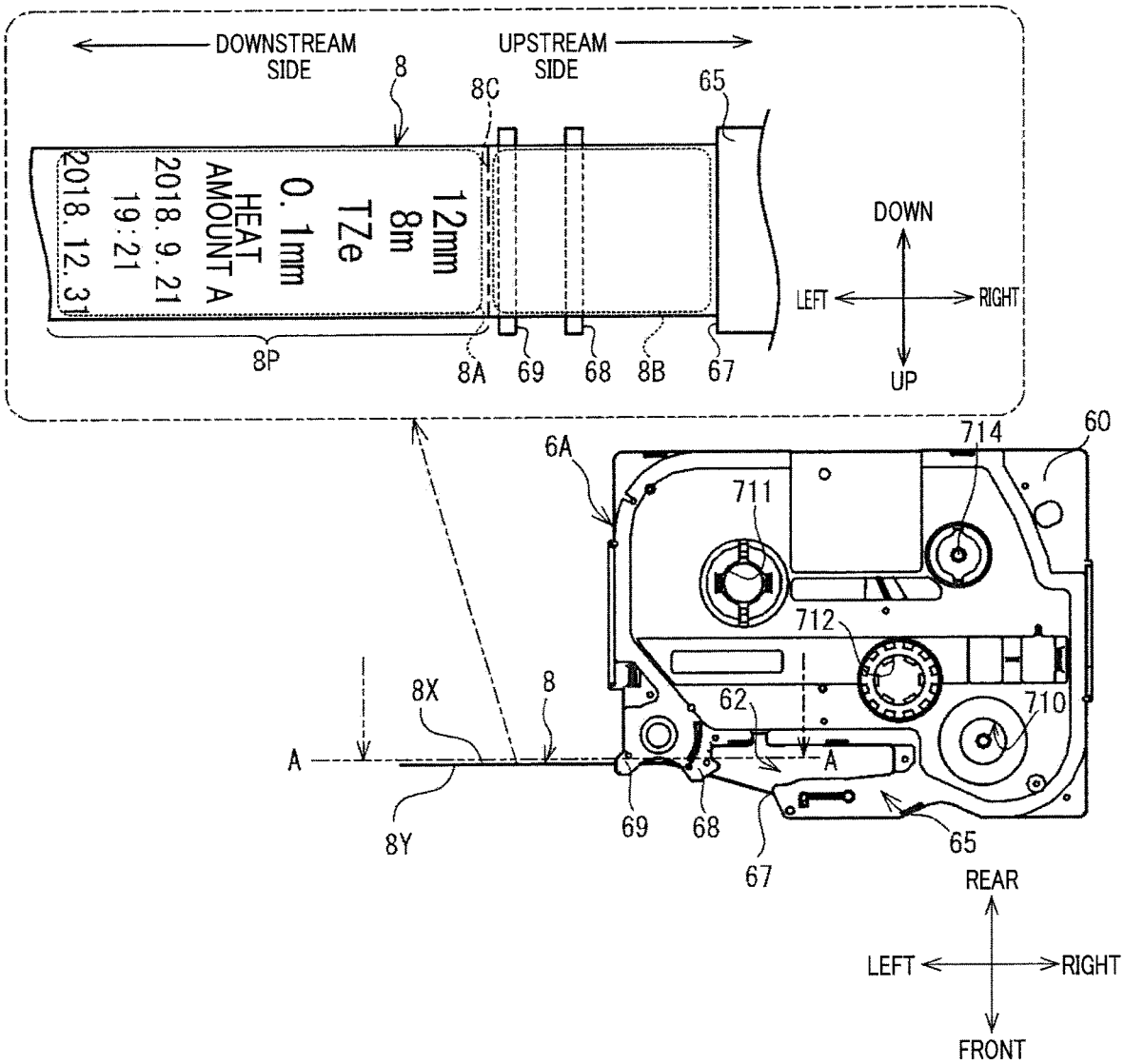
FIG. 5 is a view of a cassette according to a first embodiment.

There will be next described a cassette 6A according to a first embodiment with reference to FIG. 5. In the cassette 6A, the protruding portion 8P extends leftward from the output portion 69. The cassette information is printed on the protruding portion 8P. The cassette information includes (1) the width of the tape 8 (12 mm), (2) the entire length of the tape 8 (8 m), (3) a model (TZe) allowing identification of whether the cassette 6 is of a receptor type or a laminate type, (4) the thickness of the tape 8 (0.1 mm), (5) an amount of heat which is required for heating the ink ribbon 4 (an amount of heat A), (6) the date and time of the last use (2018 Sep. 21 19:21), and (7) an expiry date (2018 Dec. 31), each of which is represented by characters. One of opposite surfaces of the protruding portion 8P is an indicating surface 8X which faces rearward and on which the cassette information is viewable. The other surface is a non-indicating surface 8Y facing frontward.

The indicating surface 8X of the tape 8 has an indicator portion 8A on which the cassette information is printed at the protruding portion 8P. The indicating surface 8X of the tape 8 further has a non-indicator portion 8B which is located upstream of and adjacent to the indicator portion 8A and on which no information is to be printed. A boundary region between the indicator portion 8A and the non-indicator portion 8B is located slightly downstream of the output portion 69. A half-cut line 8C is formed in the boundary region between the indicator portion 8A and the non-indicator portion 8B. One of a first half-cut line and a second half-cut line is selectively used as the half-cut line 8C.

The first half-cut line has at least one entire cut portion that is cut across the protruding portion 8P in the thickness direction at at least one portion of the protruding portion 8P in the widthwise direction. That is, the entire cut portion divides each of a portion of the substrate of the tape 8 and a portion of the release paper sheet of the tape 8 in the widthwise direction, into a portion including the indicator portion 8A and a portion including the non-indicator portion 8B with respect to the boundary region. One example of the first half-cut line is perforation constituted by a plurality of the entire cut portions formed non-continuously in the widthwise direction. The tape 8 is separable at the first half-cut line. In the case where the tape 8 is separated at the first half-cut line, the protruding portion 8P is cut off from the cassette 6A.

In a first example of the second half-cut line, a half-cut portion cut across only the substrate in the thickness direction in the protruding portion 8P is formed at the entirety or a portion of the protruding portion 8P in the widthwise direction. No cut portion is formed in the release paper sheet. By cutting off the substrate of the protruding portion 8P of the tape 8, it is possible to peel the substrate from the release paper sheet of the protruding portion 8P. A surface of the cut-off substrate which is an opposite side of the substrate from the indicating surface 8X is exposed with adhesive provided on the surface.

Effects in First Embodiment

The protruding portion 8P of the tape 8 which protrudes to the outside of the housing 60 has the indicator portion 8A on which the cassette information is printed. This configuration enables the user to recognize the cassette information relating to the cassette 6 by viewing the cassette information provided on the protruding portion 8P. Accordingly, the cassette 6 can notify the user of the cassette information at low cost without the need to stick a seal to the housing 60, for example.

The tape 8 has the half-cut line 8C between the indicator portion 8A and the non-indicator portion 8B. This configuration enables the user to easily cut off the indicator portion 8A from the non-indicator portion 8B at the half-cut line 8C. In this case, the user can stick the cut-off indicator portion 8A to the housing 60 of the cassette 6 to effectively use the cut-off indicator portion 8A.

Depending upon specifications of the printer 1, the user in some cases needs to cut off the protruding portion 8P from the cassette 6 when mounting the cassette 6 onto the printer 1. In the case where the first half-cut line is formed at the boundary region between the indicator portion 8A and the non-indicator portion 8B in the cassette 6, in contrast, the first half-cut line makes it easy for the user to cut off the protruding portion 8P from the cassette 6. Accordingly, the user can easily mount the cassette 6 onto the printer 1.

One of the first half-cut line and the second half-cut line is selectively used as the half-cut line 8C in the cassette 6A. For example, in the case where the first half-cut line is formed, the user can easily cut off the protruding portion 8P from the cassette 6. For example, in the case where the second half-cut line is formed, the user can easily peel the substrate containing the indicator portion 8A in the protruding portion 8P, from the release paper sheet.

The cassette 6A includes the storage 63A that stores the cassette information. This configuration enables printing on the protruding portion 8P of the tape 8 in a process of manufacturing the cassette 6 by referring to the cassette information stored in the storage 63A, for example.

The cassette 6 is of the receptor type in which the ink of the ink ribbon 4 is transferred to the tape 8 to perform printing. That is, the disclosure in the first embodiment is applicable to cassettes of the receptor type.

Second Embodiment (Cassette 6B)

Figure 6A:
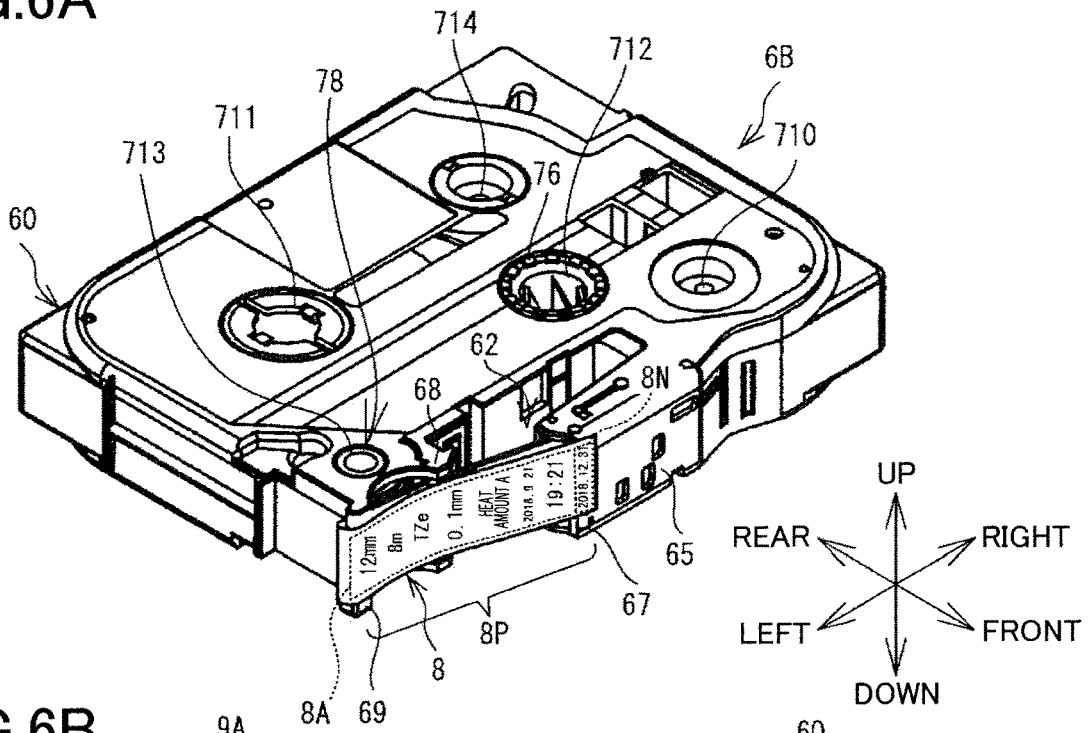
FIG. 6A is a view of a cassette according to a second embodiment.
Figure 6B:
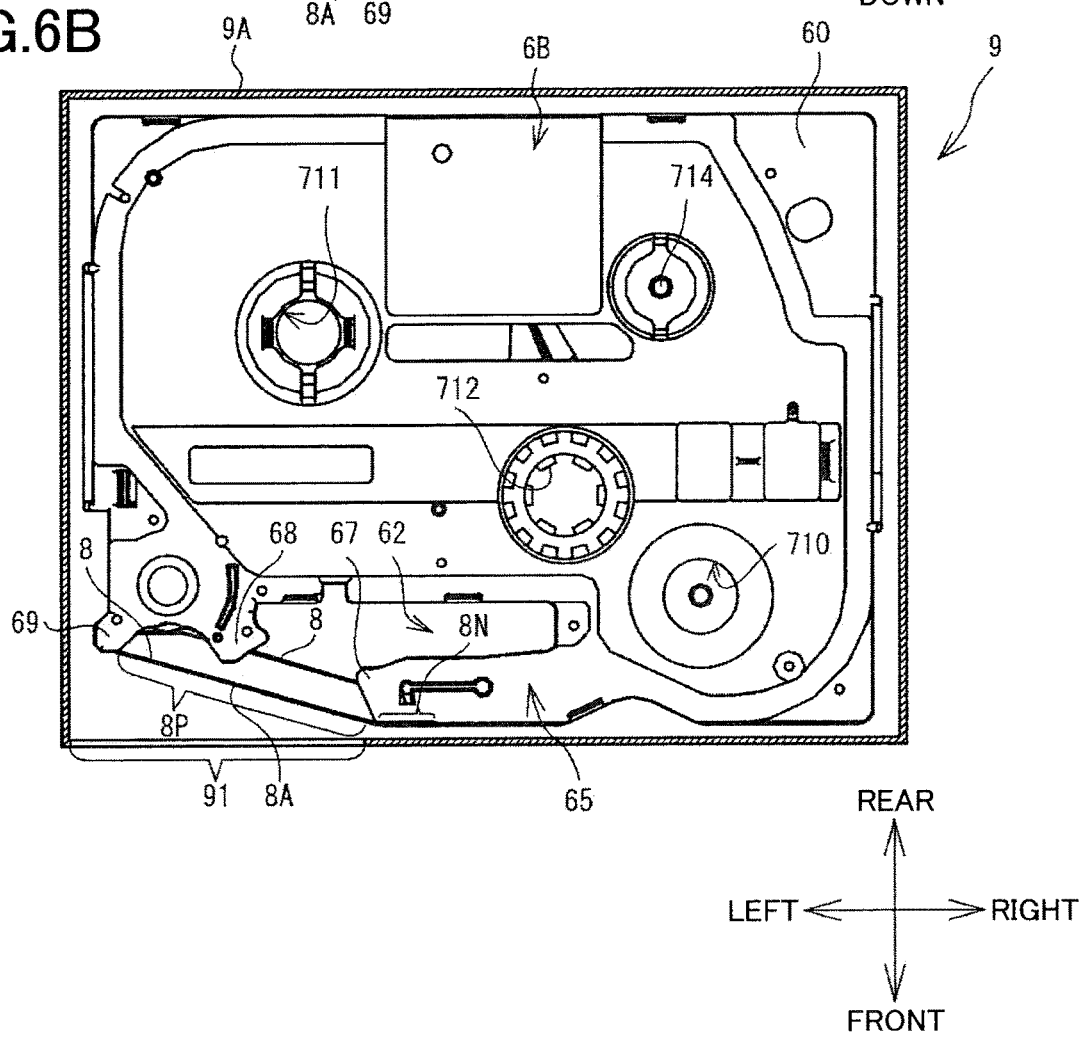
FIG. 6B is a view of a cassette body containing the cassette.

There will be next described a cassette 6B according to a second embodiment with reference to FIGS. 6A and 6B. In the cassette 6B, the release paper sheet is peeled off from the substrate at a portion of a downstream end portion of the protruding portion 8P. As a result, adhesive is exposed at a downstream end portion of the non-indicating surface of the protruding portion 8P. Hereinafter, a portion of the non-indicating surface of the protruding portion 8P from which the adhesive is exposed will be referred to as "adhesive portion 8N".

As illustrated in FIG. 6A, the protruding portion 8P extends in an obliquely front right direction from the output portion 69 toward a distal end of the arm portion 65 of the housing 60. The adhesive portion 8N of the protruding portion 8P is stuck to an outer surface of a front wall of the arm portion 65. This temporarily secures the protruding portion 8P to the arm portion 65 to stabilize the protruding portion 8P in a state in which the indicator portion 8A faces frontward.

As illustrated in FIG. 6B, the cassette 6B is contained in a bag 9A in an unused state. The bag 9A surrounds the cassette 6B. A window 91 is formed in a portion of the front end portion of the bag 9A, which portion is opposed to the indicator portion 8A of the protruding portion 8P. The window 91 has transparency. The indicator portion 8A disposed in the bag 9A is viewable from the outside through the window 91. Hereinafter, the bag 9A and the cassette 6 contained in the bag 9A will be collectively referred to as "cassette body 9".

Effects in Second Embodiment

In the cassette 6B, the adhesive portion 8N is formed at the downstream end portion of the non-indicating surface of the protruding portion 8P. The adhesive portion 8N of the protruding portion 8P is temporarily secured to the arm portion 65 to stabilize the protruding portion 8P in a state in which the indicator portion 8A faces outward. This enables the user to easily check the cassette information.

The window 91 is formed in a portion of the front end portion of the bag 9A covering the cassette 6B, which portion is opposed to the indicator portion 8A of the protruding portion 8P. The indicator portion 8A disposed in the bag 9A is viewable from the outside through the window 91. This enables the user to check the cassette information even in the state in which the cassette 6B is contained in the bag 9A.

Third Embodiment (Cassette 6C)

Figure 7:
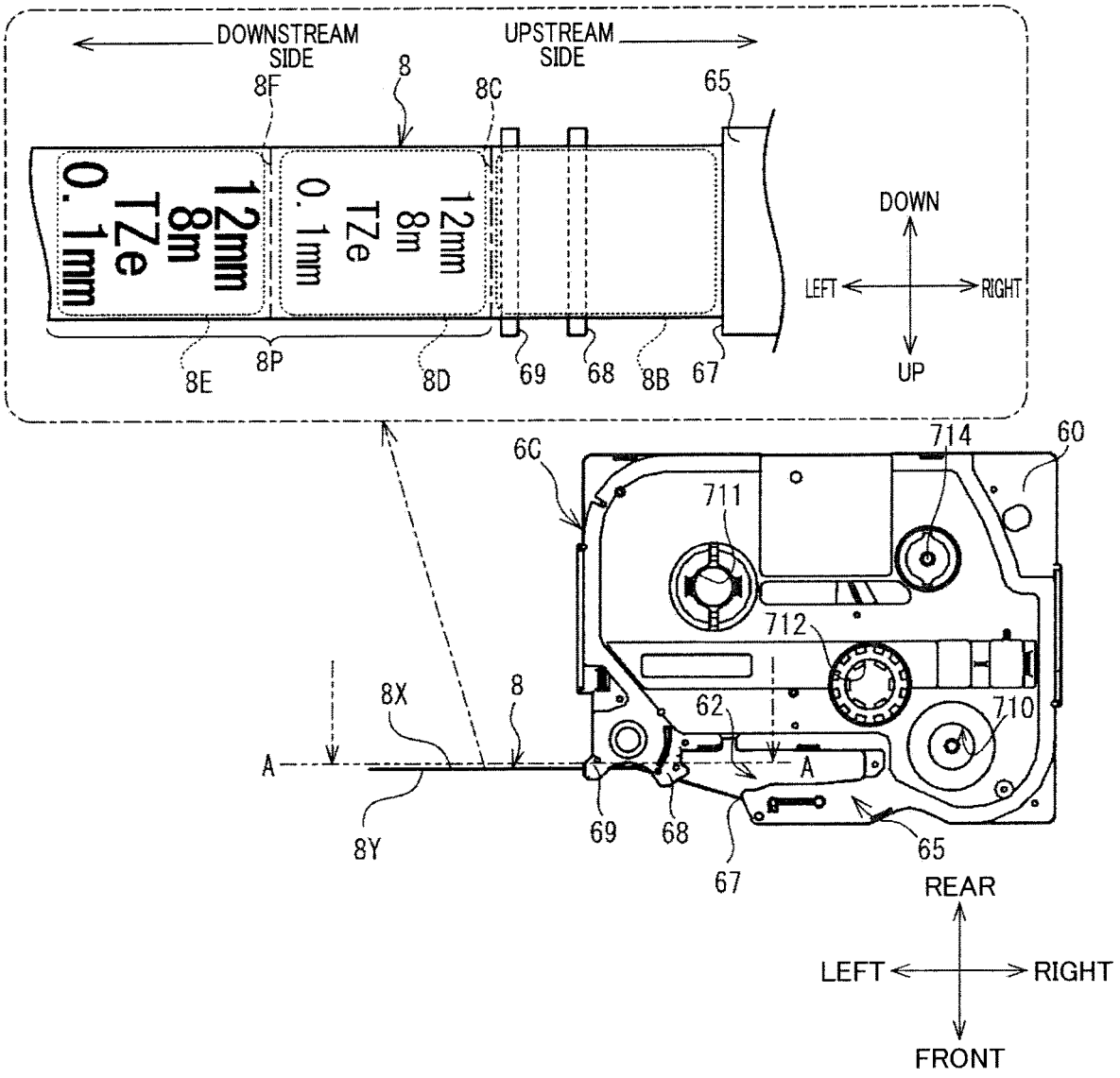
FIG. 7 is a view of a cassette according to a third embodiment.

There will be next described a cassette 6C according to a third embodiment with reference to FIG. 7. The cassette 6C is different from the cassette 6A (see FIG. 5) according to the first embodiment in that the tape 8 has a first indicator portion 8D and a second indicator portion 8E each as the indicator portion and further has a half-cut line 8F. The first indicator portion 8D and the second indicator portion 8E are arranged in a direction in which the tape 8 extends. The first indicator portion 8D is located upstream of and adjacent to the second indicator portion 8E. The non-indicator portion 8B is located upstream of and adjacent to the first indicator portion 8D. The half-cut line 8C is formed in a boundary region between the first indicator portion 8D and the non-indicator portion 8B.

The cassette information (1)-(4) is printed on each of the first indicator portion 8D and the second indicator portion 8E. The first indicator portion 8D and the second indicator portion 8E are different from each other in a manner of printing of the cassette information. Specifically, the first indicator portion 8D and the second indicator portion 8E are different from each other in the size of characters contained as the cassette information. The size of the characters as the cassette information to be printed on the second indicator portion 8E is greater than the size of the characters as the cassette information to be printed on the first indicator portion 8D.

The half-cut line 8F is formed in the boundary region between the first indicator portion 8D and the second indicator portion 8E. As in the first embodiment, the first half-cut line or the second half-cut line is used as the half-cut line 8F.

Effects in Third Embodiment

The indicator portion of the protruding portion 8P of the tape 8 has the first indicator portion 8D and the second indicator portion 8E. The cassette information is the same but its print manner is different between the first indicator portion 8D and the second indicator portion 8E. Specifically, the size of printed characters as the cassette information is different between the first indicator portion 8D and the second indicator portion 8E. This configuration enables the user to recognize the cassette information by selectively viewing one of the indicator portions which is more easily viewed by the user. That is, the user can appropriately check the cassette information indicated on the first indicator portion 8D and the second indicator portion 8E in different manners.

The half-cut line 8F is formed in the boundary region between the first indicator portion 8D and the second indicator portion 8E. This configuration enables the user to easily cut off the first indicator portion 8D and the second indicator portion 8E at the half-cut line 8F. In this case, the user can stick the cut-off first indicator portion 8D and second indicator portion 8E to the housing 60 to effectively use the cut-off first indicator portion 8D or second indicator portion 8E. Also, two labels indicating the cassette information (the first indicator portion 8D and the second indicator portion 8E) are formed, enabling the user to stick the first indicator portion 8D and the second indicator portion 8E to different positions on the housing 60. This improves convenience in the case where the label including the cassette information is stuck to the housing 60. Also, as described above, the size of characters is different between the first indicator portion 8D and the second indicator portion 8E. Accordingly, the user can selectively use one of the first indicator portion 8D and the second indicator portion 8E, depending upon a situation in which a cut-off portion of the tape 8 is used. This enables the user to more easily recognize the cassette information.

Fourth Embodiment (Cassette 6D)

Figure 8:
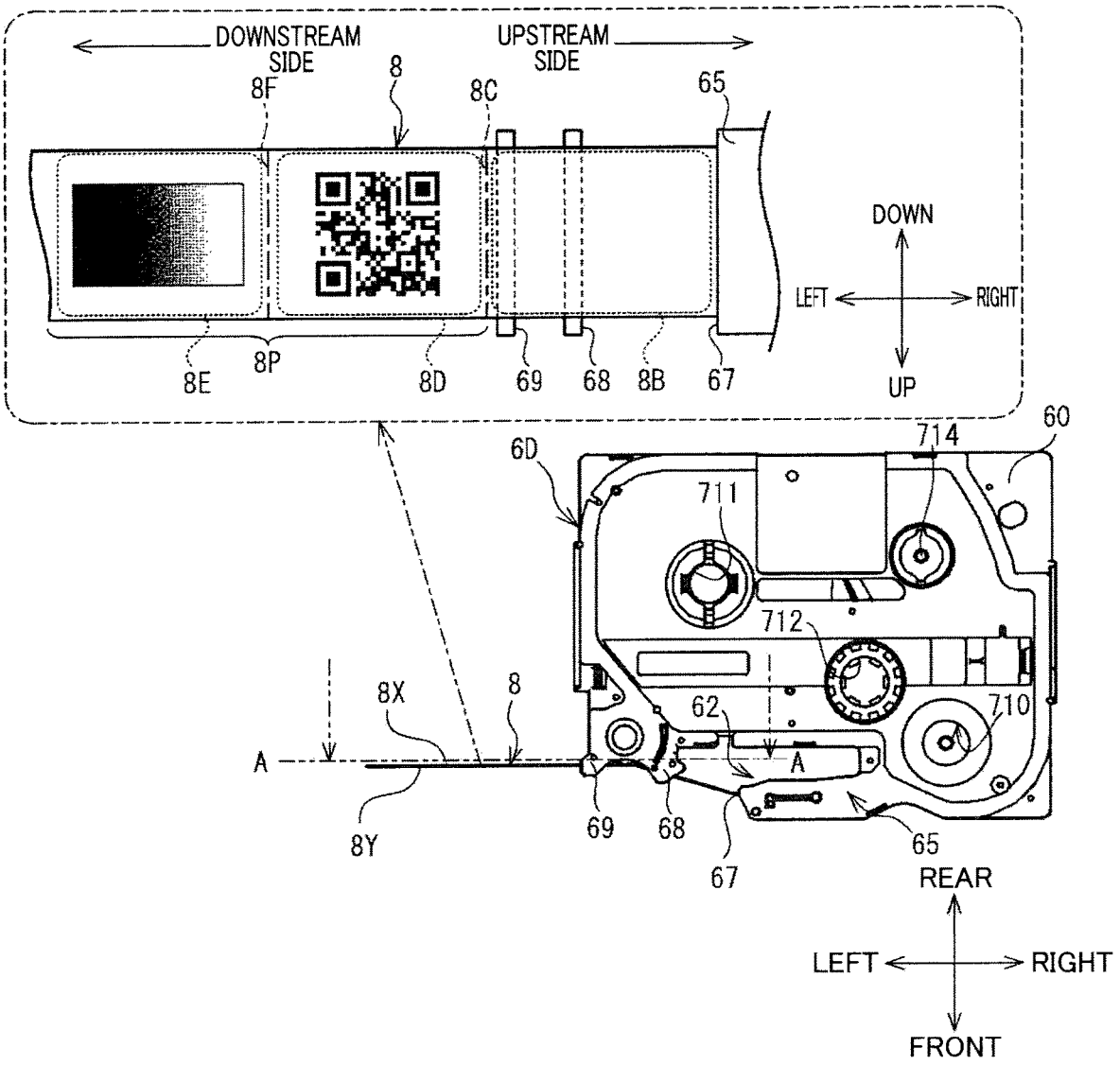
FIG. 8 is a view of a cassette according to a fourth embodiment.

There will be next described a cassette 6D according to a fourth embodiment with reference to FIG. 8. The cassette 6D is different from the cassette 6C (see FIG. 7) according to the third embodiment in the cassette information to be printed on the first indicator portion 8D and the second indicator portion 8E of the indicating surface 8X of the protruding portion 8P. Specifically, a two-dimensional QR code is printed on the first indicator portion 8D as cassette information (8). The two-dimensional QR code is created based on a part of the cassette information (1)-(7), for example. Gray-level information is printed on the second indicator portion 8E as cassette information (9). The gray-level information indicates gradual change in print density. The gray-level information indicates a plurality of print densities adjustable in printing by the printer 1.

Effects in Fourth Embodiment

The two-dimensional QR code is printed as the cassette information, enabling the user to recognize a large amount of the cassette information when compared with a case where characters are directly printed. In the case where gray-level information printed by another printer using another cassette is stuck to the housing 60 of the cassette 6D, for example, the gray-level information is not preferable because the gray-level information may be different from gray-level representation achieved in the case where the cassette 6D is used. In the present embodiment, in contrast, the printer 1 uses the cassette 6D to print the gray-level information indicated on the second indicator portion 8E as the cassette information, enabling the user to accurately recognize a print manner in the case where the gray levels are printed.

Fifth Embodiment (Cassette 6E)

Figure 9A:
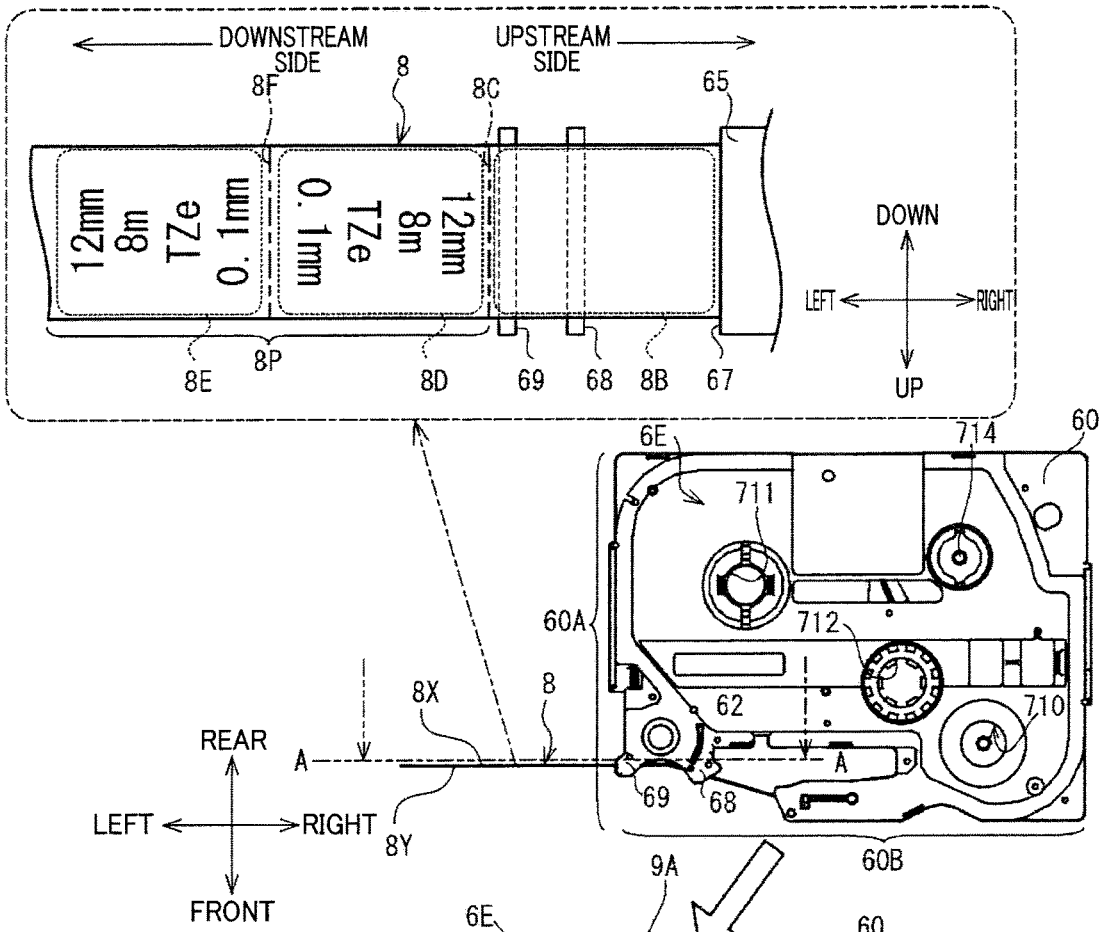
FIGS. 9A through 9C are views of a cassette according to a fifth embodiment, and a cassette body containing the cassette.
Figure 9B:
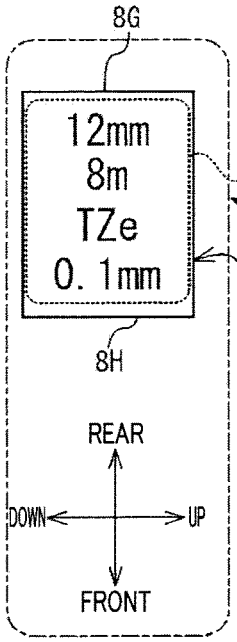
Figure 9B:
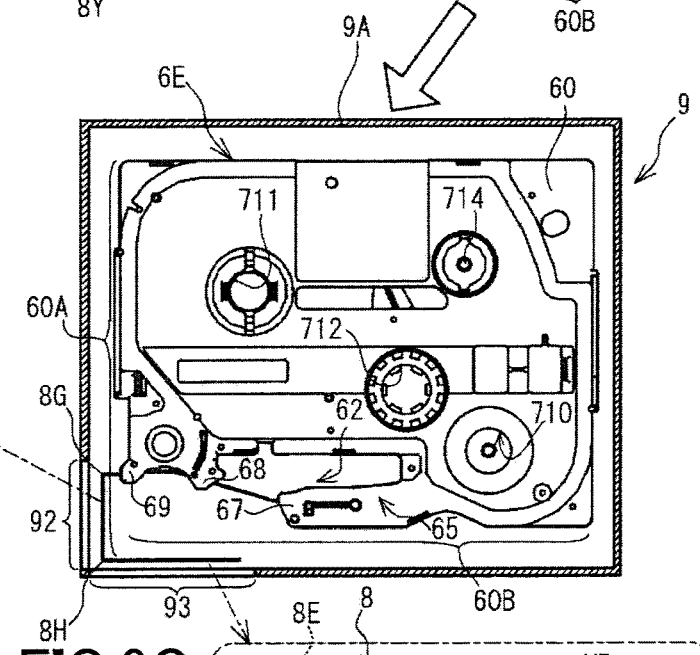
Figure 9C:
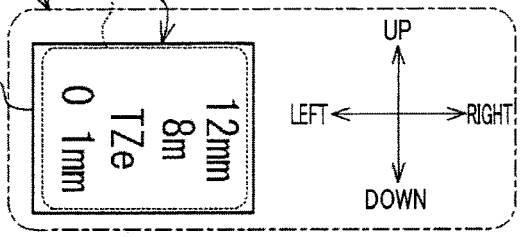

There will be next described a cassette 6E according to a fifth embodiment with reference to FIGS. 9A-9C. As illustrated in FIG. 9A, the cassette 6E is different from the cassette 6C (see FIG. 7) according to the third embodiment in a manner of the cassette information (1)-(4) printed on the first indicator portion 8D and the second indicator portion 8E of the indicating surface 8X of the protruding portion 8P. Specifically, characters representing the cassette information (1)-(4) are printed on the first indicator portion 8D so as to be arranged in a direction directed from the upstream side toward the downstream side. The writing direction of each cassette information (1)-(4) printed on the first indicator portion 8D coincides with the down direction. Characters representing the cassette information (1)-(4) are printed on the second indicator portion 8E so as to be arranged in a direction directed from the downstream side toward the upstream side. The writing direction of each cassette information (1)-(4) printed on the second indicator portion 8E coincides with the up direction. That is, the writing direction of each cassette information (1)-(4) printed on the first indicator portion 8D and the writing direction of each cassette information (1)-(4) printed on the second indicator portion 8E are opposite to each other.

The cassette 6E is contained in the bag 9A in a state in which the tape 8 is bent at the half-cut lines 8C, 8F. That is, a portion of the protruding portion 8P at which the half-cut line 8C is formed serves as a bendable portion 8G formed in a boundary region between the first indicator portion 8D and the non-indicator portion 8B. A portion of the protruding portion 8P at which the half-cut line 8F is formed serves as a bendable portion 8H formed in a boundary region between the first indicator portion 8D and the second indicator portion 8E. A left wall of the housing 60 of the cassette 6E which includes the output portion 69 is defined as a first outer surface 60A. A front wall of the housing 60 of the cassette 6E which is adjacent to a front end portion of the first outer surface 60A is defined as a second outer surface 60B. In this case, as illustrated in FIG. 9B, a portion of the non-indicating surface of the protruding portion 8P, which portion is located on an opposite side of the protruding portion 8P from the first indicator portion 8D, is opposed to the first outer surface 60A. As illustrated in FIG. 9C, a portion of the non-indicating surface of the protruding portion 8P, which portion is located on an opposite side of the protruding portion 8P from the second indicator portion 8E, is opposed to the second outer surface 60B.

A window 92 is formed in a left end portion of the bag 9A at a position opposed to the first indicator portion 8D of the protruding portion 8P. A window 93 is formed in the front end portion of the bag 9A at a position opposed to the second indicator portion 8E of the protruding portion 8P. The first indicator portion 8D disposed in the bag 9A is viewable from the outside through the window 92, and the second indicator portion 8E is viewable from the outside through the window 93. It is noted that the bag 9A may have through holes as the windows 92, 93.

Effects in Fifth Embodiment

In the cassette 6E, the first indicator portion 8D is disposed at a position opposed to the first outer surface 60A of the housing 60, and the second indicator portion 8E is disposed at a position opposed to the second outer surface 60B. This configuration enables the user to recognize the cassette information on the first indicator portion 8D through the window 92 in a state in which the cassette body 9 is disposed such that the first outer surface 60A in the cassette 6E faces upward, for example. The configuration further enables the user to recognize the cassette information on the second indicator portion 8E through the window 93 in a state in which the cassette body 9 is disposed such that the second outer surface 60B in the cassette 6E faces upward, for example. Thus, the user can check the cassette information by viewing the cassette body 9 in each of the different directions.

The writing direction of the cassette information printed on the first indicator portion 8D and the writing direction of the cassette information printed on the second indicator portion 8E are different from each other. With this configuration, even in the case where a direction in which the user views the housing 60 changes depending upon a state of the cassette body 9, the user can further easily check the cassette information in each state.

Sixth Embodiment (Cassette 6F)

Figure 10:
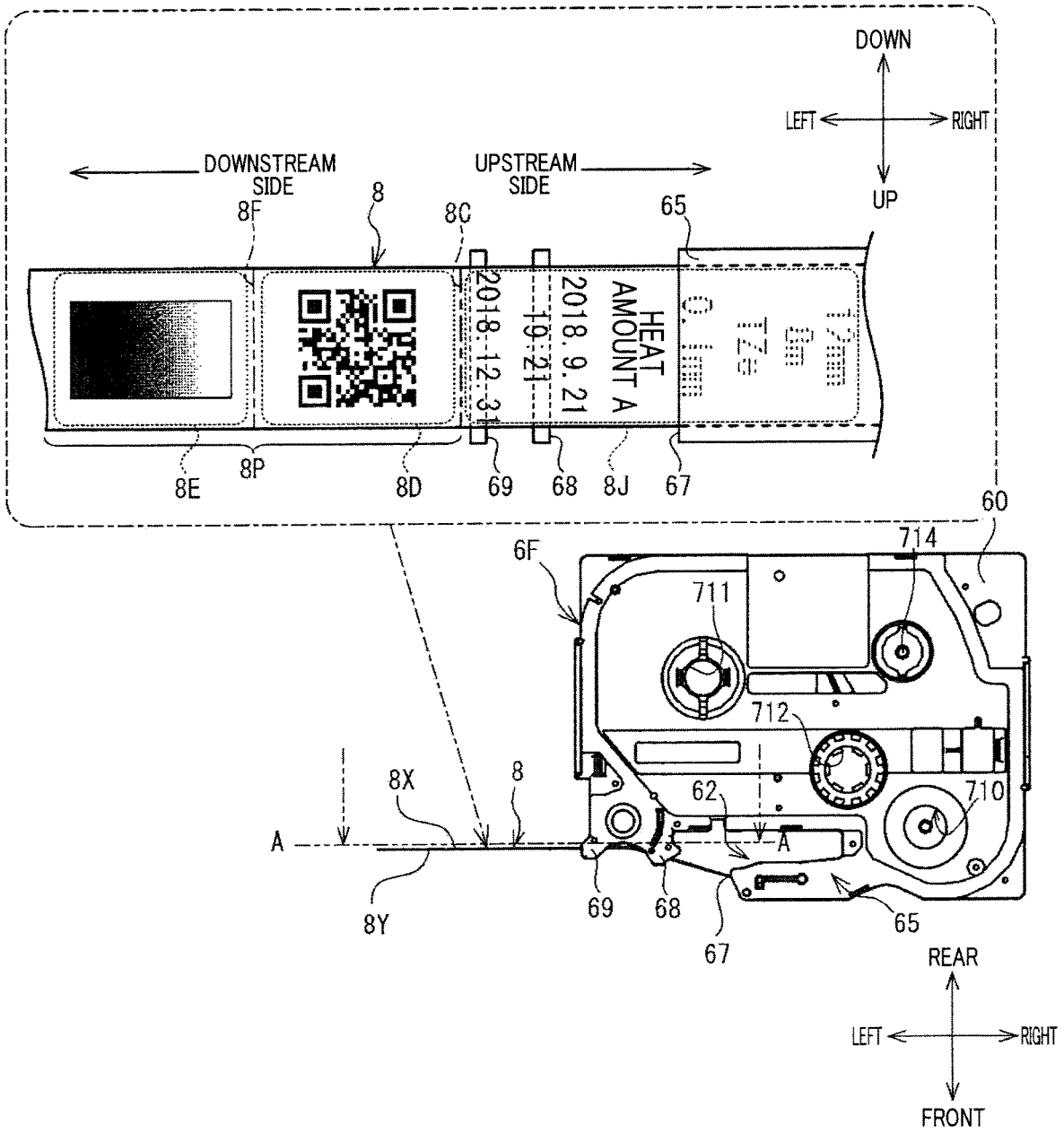
FIG. 10 is a view of a cassette according to a sixth embodiment.

There will be next described a cassette 6F according to a sixth embodiment with reference to FIG. 10. The cassette 6F is different from the cassette 6D (see FIG. 8) according to the fourth embodiment in that the tape 8 has a third indicator portion 8J instead of the non-indicator portion 8B. The third indicator portion 8J is located upstream of and adjacent to the first indicator portion 8D. A portion of the third indicator portion 8J is located upstream of the protruding portion 8P. In other words, a portion of the third indicator portion 8J is located upstream of the output portion 69, that is, a portion of the third indicator portion 8J is located in the housing 60. The cassette information (1)-(7) is printed on the third indicator portion 8J. It is noted that the cassette information printed on the portion of the third indicator portion 8J which is located upstream of the arm opening 67, i.e., in the arm portion 65, cannot be viewed from the outside.

Effects in Sixth Embodiment

In the cassette 6F, the thermal head 29 held by the head holder 291 inserted in the head inserted portion 62 heats the ink ribbon 4. As a result, the ink of the ink ribbon 4 is transferred to a portion of the tape 8 which extends between the arm opening 67 and the ribbon separator 68. The tape 8 to which the ink is transferred is conveyed downstream. Thus, the printer 1 is capable of performing printing on the tape 8 located upstream of the thermal head 29 at the start of printing but is not capable of performing printing on the tape 8 located downstream of the thermal head 29.

In the cassette 6F, in contrast, the cassette information is indicated in advance on the portion of the tape 8 which is located upstream of the output portion 69, i.e., in the housing 60. Thus, in the case where the third indicator portion 8J is discharged to the outside of the housing 60 after the start of printing by the printer 1, for example, the user can use the third indicator portion 8J as a label for notifying the user of the cassette information. That is, a region on the tape 8 on which printing cannot be performed by the thermal head 29 can also be used as a region for indicating the cassette information in the cassette 6F. Accordingly, the cassette 6F can be used by the user, with the cassette information being formed on the tape 8 with its effective use.

Modification (Cassette 6G)

Figure 11:
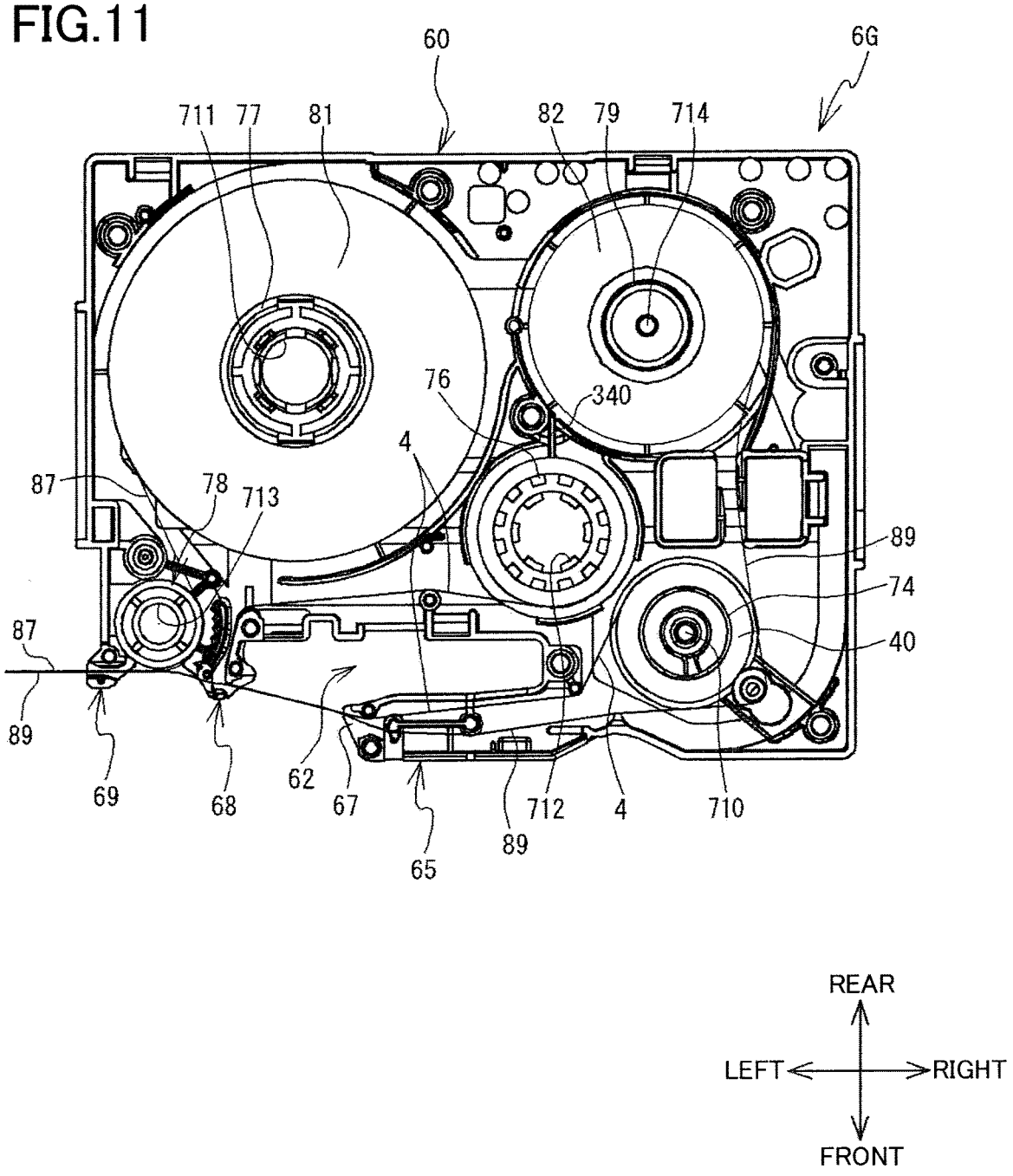
FIG. 11 is a plan view of an internal structure of a cassette according to a modification.

There will be next described a cassette 6G with reference to FIG. 11. The cassette 6G is of a laminate type unlike the cassettes in the first to sixth embodiments. The cassette 6G includes the housing 60 that is the same as the housing 60 of the cassette 6 of the receptor type. The cassette 6G is different from the cassettes 6A-6F of the receptor type in that a film spool 77 is rotatably supported by the support hole 711, and that a tape spool 79 is rotatably supported by the tape boss 714.

A film roll 81 is rotatably supported by the film spool 77. A double-sided adhesive film 87 is wound around the film roll 81. The release paper sheet is stuck to one of opposite surfaces of the double-sided adhesive film 87. The double-sided adhesive film 87 extends frontward from the film roll 81, is bent leftward by being wrapped around the drive roller 78, and extends to the output portion 69.

A tape roll 82 is rotatably supported by the tape spool 79. A tape 89 constituted by a transparent substrate is wound around the tape roll 82. The tape 89 extends downward from the tape roll 82, passing through a right side of the ribbon spool 74, is being leftward, and extends toward the arm opening 67. In the arm opening 67, the ink ribbon 4 is placed on the tape 89. The tape 89 and the ink ribbon 4 arranged one on another are exposed from the arm opening 67 to the outside and conveyed to the ribbon separator 68. The ink ribbon 4 is separated from the tape 89 by the ribbon separator 68 and extends to the ribbon take-up spool 76. The tape 89 from which the ink ribbon 4 is separated by the ribbon separator 68 is placed on the double-sided adhesive film 87 in front of the drive roller 78. The tape 89 and the double-sided adhesive film 87 arranged one on another extend to the output portion 69.

The printer 1 in which the cassette 6G is mounted on the cassette holder 22 performs a printing operation as follows. In response to rotation of the ribbon take-up shaft 33 (see FIG. 3) inserted in the ribbon take-up spool 76, the ribbon take-up spool 76 draws and takes up the ink ribbon 4 from the ribbon roll 40. The platen roller 30 (see FIG. 3) presses the tape 89 and the ink ribbon 4 arranged one on another, against the thermal head 29. Heat generated by the thermal head 29 transfers the ink of the ink ribbon 4 to the tape 89. The drive roller 78 is rotated by rotation of the drive-roller shaft 32 (see FIG. 3) inserted in the drive roller 78. The drive roller 78 and the tape sub-roller 31 (see FIG. 3) of the platen holder 38 cooperate to convey the double-sided adhesive film 87 and the tape 89. The printed tape 89 from which the ink ribbon 4 is separated is pressed against and stuck to the double-sided adhesive film 87 by the drive roller 78 and the tape sub-roller 31. The tape 89 and the double-sided adhesive film 87 stuck to each other is discharged from the output portion 69 to the outside of the cassette 6 by rotation of the drive roller 78.

Figure 12:
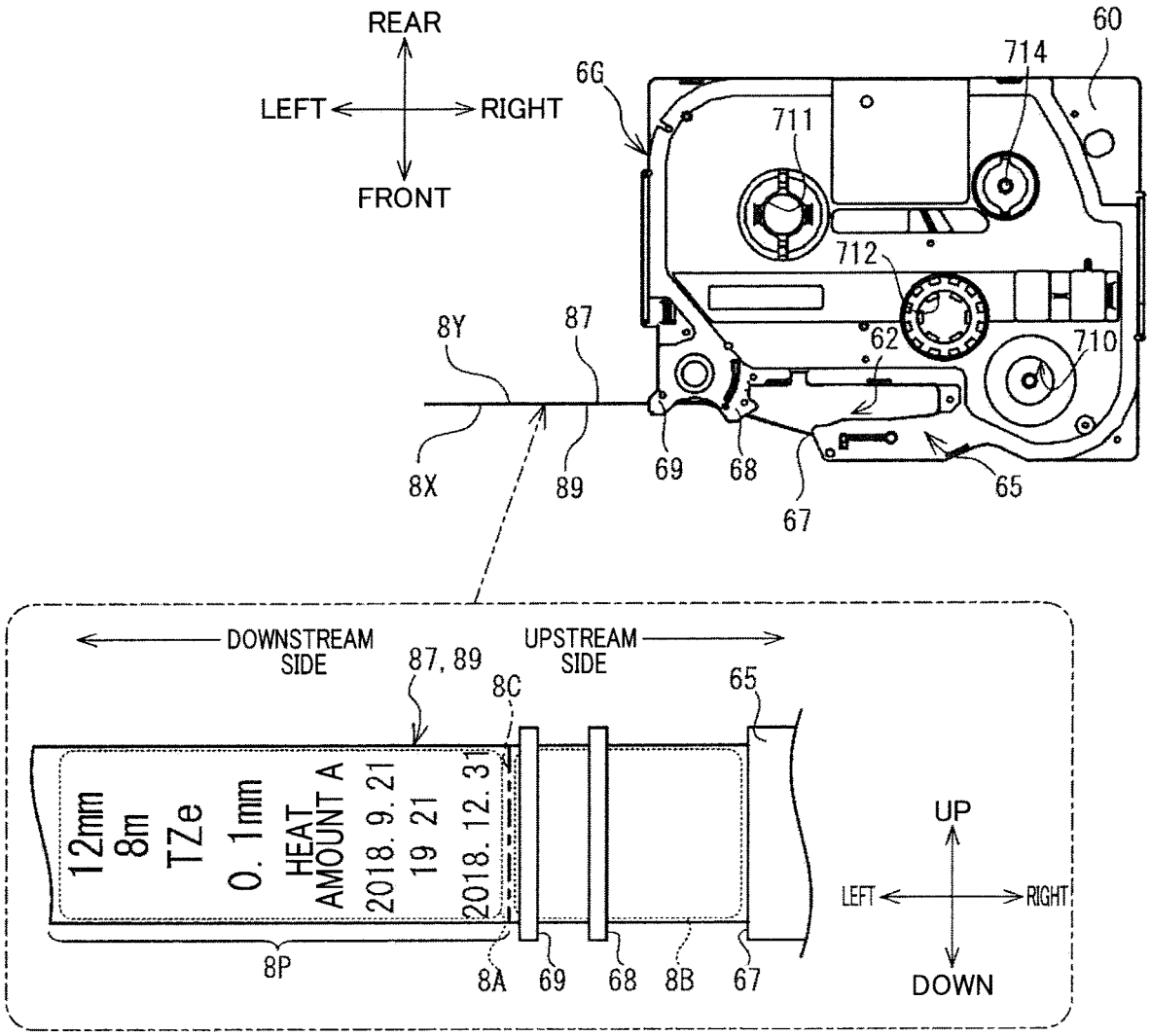
FIG. 12 is a view of a cassette according to another modification.

In a state in which the cassette 6G is removed from the printer 1, as illustrated in FIG. 12, a portion of the tape 89 and the double-sided adhesive film 87 stuck to each other protrudes to the outside of the housing 60 as in the above-described embodiments. The portion of the tape 89 and the double-sided adhesive film 87 which protrudes to the outside of the housing 60 corresponds to the protruding portion 8P. The protruding portion 8P protrudes leftward from the output portion 69. The cassette information (1)-(7) is printed on the protruding portion 8P. At the protruding portion 8P, the printed cassette information is viewable through the tape 89 at one of opposite surfaces of the tape 89 which is located on an opposite side from the double-sided adhesive film 87. Thus, unlike the above-described embodiments, the indicating surface 8X of the protruding portion 8P on which the cassette information is viewable faces frontward. The non-indicating surface 8Y that is the other side from the indicating surface 8X faces rearward. The half-cut line 8C is formed in the boundary region between the indicator portion 8A and the non-indicator portion 8B.

Effects in Modification

The cassette 6G is of the laminate type in which printing is performed by sticking the double-sided adhesive film 87 to the tape 89 to which the ink of the ink ribbon 4 is transferred. That is, the present disclosure is applicable not to the cassettes of the receptor type according to the first to sixth embodiments but also to the cassette of the laminate type according to this modification.

Figure 13A:
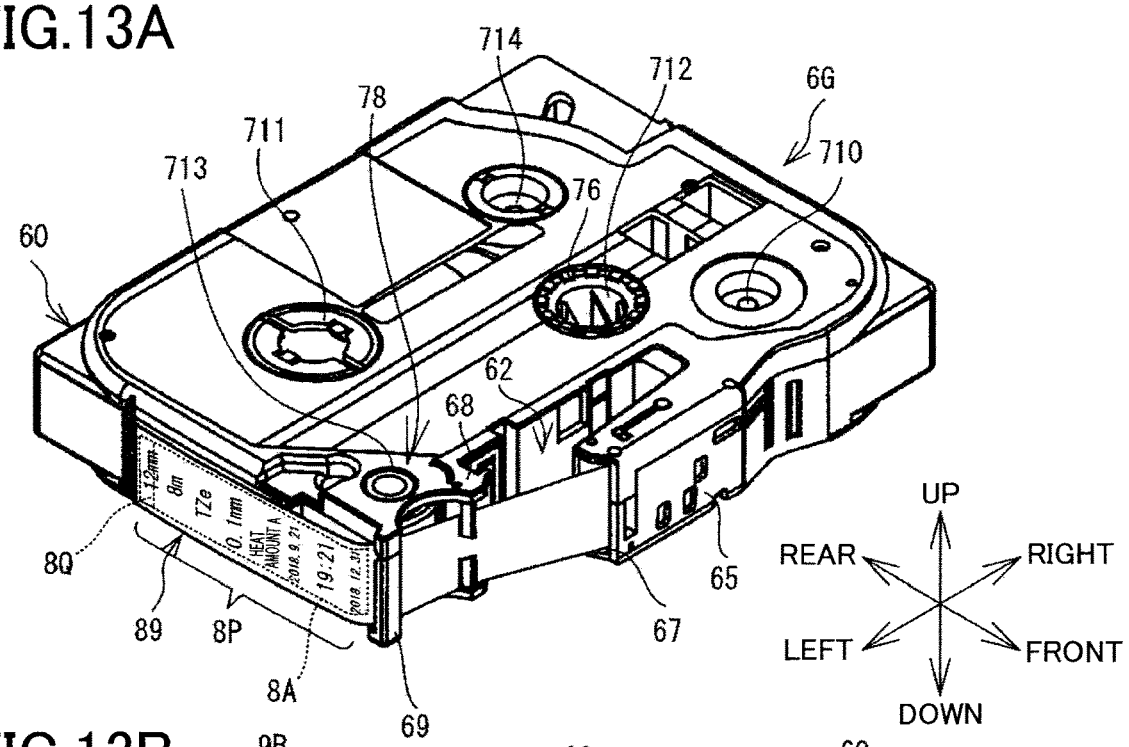
FIG. 13A is a view of a cassette according to yet another modification.

It is noted that, as in the second embodiment (see FIG. 6), the release paper sheet of the double-sided adhesive film 87 may be peeled at a portion of the downstream end portion of the protruding portion 8P in the cassette 6G. In this case, adhesive is exposed at the downstream end portion of the non-indicating surface of the protruding portion 8P. Hereinafter, as illustrated in FIG. 13A, a portion of the non-indicating surface of the protruding portion 8P at which the adhesive is exposed will be referred to as "adhesive portion 8Q". The protruding portion 8P extends rearward from the output portion 69 along the left wall of the housing 60. The adhesive portion 8Q of the protruding portion 8P is stuck to an outer surface of the left wall at a position located at a rear of the center of the left wall in the front and rear direction. This temporarily secures the protruding portion 8P to the housing 60 to stabilize the protruding portion 8P in a state in which the indicator portion 8A faces leftward.

Figure 13B:
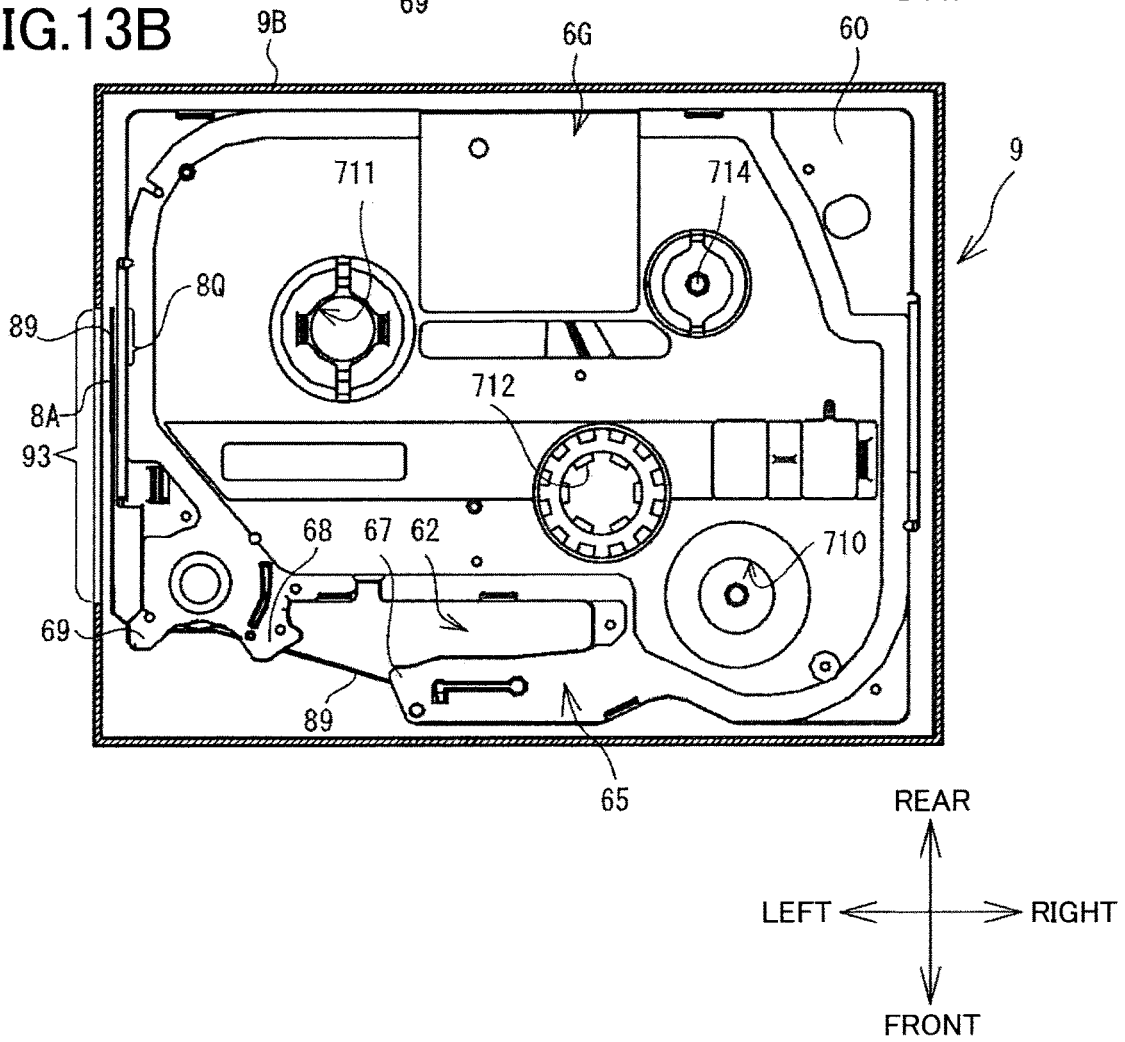
FIG. 13B is a view of a cassette body containing the cassette.

As illustrated in FIG. 13B, the cassette 6G contains the bag 9B in an unused state. The window 93 having transparency may be formed in a portion of the left end portion of the bag 9B which is opposed to the indicator portion 8A of the protruding portion 8P. In this case, the indicator portion 8A disposed in the bag 9B is viewable from the outside through the window 93.

Other Modifications

While the embodiments and the modification have been described above, it is to be understood that the disclosure is not limited to the details of the illustrated embodiments and the modification, but may be embodied with various changes and further modifications, which may occur to those skilled in the art, without departing from the spirit and scope of the disclosure. While the following modifications will be described by taking the cassette 6A in the first embodiment as one example unless otherwise explained, the following modifications may apply to the other embodiments.

The cassette information to be printed on the protruding portion 8P of the tape 8 is not limited to the above-described examples and may be any other information. Information different from the information relating to the cassette 6 may be printed on the protruding portion 8P of the tape 8. Only a portion of the cassette information may be stored in the storage 63A of the cassette 6A. That is, the information to be printed on the protruding portion 8P of the tape 8 and the information stored in the storage 63A only need to be the same as each other at least partly. The storage 63A stores information different from the cassette information. For example, the storage 63A may store information such as the name and the logo of a manufacturer of the cassette 6A. The controller of the printer 1 may read information stored in the storage 63A of the cassette 6A in a method different from that using the electrodes 34, 63. The storage 63A may not be provided on the cassette 6A.

The half-cut line 8C is not limited to the first half-cut line and the second half-cut line in the above-described embodiments. For example, a half-cut portion cut across only the release paper sheet in the thickness direction in the protruding portion 8P may be formed at the second half-cut line in the entirety or a portion of the protruding portion 8P in the widthwise direction. No cut portion may be formed in the substrate. This configuration enables the user to easily peel the release paper sheet from the substrate of the protruding portion 8P by cutting off the release paper sheet of the protruding portion 8P of the tape 8 from the substrate. Accordingly, the user can easily establish a state of the cassette 6 in which adhesive is exposed from the non-indicating surface of the protruding portion 8P. The half-cut line 8C may not be formed in the tape 8 at the boundary region between the indicator portion 8A and the non-indicator portion 8B.

In the second embodiment, the adhesive portion 8N of the protruding portion 8P may not be formed over the entire region of the non-indicating surface of the protruding portion 8P. The adhesive portion 8N may be stuck to a right wall of the housing 60. That is, the protruding portion 8P may be disposed across the front wall of the arm portion 65 in the right and left direction.

The bag 9A in the second embodiment may have transparency in the entirety of a front half portion of the bag 9A. The bag 9A may have a through hole as the window 91.

In the third embodiment, the indicator portion may include an indicator portion in addition to the first indicator portion 8D and the second indicator portion 8E. That is, the protruding portion 8P may include three or more indicator portions. The three or more indicator portions may be different from each other in print manner as in the third embodiment. A half-cut line may be formed in at least a portion of a boundary region for each of the three or more indicator portions. No half-cut line needs to be formed in a boundary region between the indicator portions. The difference in print manner of the cassette information is not limited to the size of the characters. For example, the first indicator portion 8D and the second indicator portion 8E may be different from each other in language, thickness, font, color, and/or other elements of characters. It should be understood that the cassette information indicated on the indicator portion is not limited to characters, two-dimensional QR codes, and a gray-level expression.

In the fifth embodiment, the protruding portion 8P may extend straight from the output portion 69 toward the arm opening 67 and further extend leftward along the front wall of the arm portion 65. The protruding portion 8P may be bent along the housing 60 at its corner portion at which the front wall and the right wall of the housing 60 intersect each other and may extend rearward along the right wall. In this case, the first indicator portion 8D may be disposed at a portion of the protruding portion 8P which extends from the output portion 69 to the corner portion at which the front wall and the right wall of the housing 60 intersect each other. The second indicator portion 8E may be provided at a portion of the protruding portion 8P which extends from the corner portion along the right wall. In this case, a portion of the housing 60 of the cassette 6E which extends from the output portion 69 to the corner portion may be defined as the first outer surface, and the right wall extending rearward from the corner portion may be defined as the second outer surface.

The protruding portion 8P may be disposed so as to cover all of the front wall, the right wall, the rear wall, and the left wall of the housing 60 of the cassette 6E. That is, the protruding portion 8P may cover the entire wall portion of the housing 60 which extends in the up and down direction. Each of the bendable portions 8G, 8H may not have the half-cut line and may have a bending line in advance.

In the fifth embodiment, each of the writing direction of the cassette information indicated on the first indicator portion 8D and the writing direction of the cassette information indicated on the second indicator portion 8E may coincide with the right and left direction. Each writing direction may be changed in accordance with the width of the tape 8. The writing direction of the cassette information indicated on the first indicator portion 8D and the writing direction of the cassette information indicated on the second indicator portion 8E may coincide with each other.

The bag 9 may have all of the window 91 of the bag 9A in the second embodiment, the window 93 of the bag 9A in the fifth embodiment. With this configuration, it is possible to share the bags between the cassette of the receptor type and the cassette of the laminate type.

Others

Each of the tape 8, the double-sided adhesive film 87, and the tape 89 is one example of a medium. The cassette information is one example of information.

What is claimed is:

1. A cassette, comprising:

a housing; and a medium contained in the housing and including a substrate and a release paper sheet stuck to the substrate, at least a portion of the substrate being contained in the housing, wherein the substrate includes an indicator portion on which information has already been printed, the information being information indicating at least one of (i) a width of the medium, (ii) an entire length of the medium and (iii) a cassette of type, and wherein the indicator portion on which the information has been printed is located outside the housing in a state in which the indicator portion continuously extends from the medium which is located inside the housing.

2. The cassette according to claim 1, further comprising a half-cut line provided on a boundary region between the indicator portion and a non-indicator portion adjacent to the indicator portion.

3. The cassette according to claim 1, further comprising an adhesive portion provided between the substrate and the release paper sheet, wherein the adhesive portion temporarily secures at protruding portion of the medium protruding to an outside of the housing to an outer surface of the housing.

4. The cassette according to claim 1, wherein the indicator portion comprises: a first indicator portion on which the information is printed in a first manner; and a second indicator portion on which the information is printed in a second manner different from the first manner, and the first indicator portion and the second indicator portion are arranged in a direction in which the medium extends.

5. The cassette according to claim 4, further comprising a half-cut line provided at a boundary region between the first indicator portion and the second indicator portion.

6. The cassette according to claim 4, wherein the housing comprises:

a first outer surface comprises an output portion configured to discharge a protruding portion of the medium to the outside of the housing; and a second outer surface adjacent to the first outer surface, wherein the cassette further comprises a bendable portion provided at a boundary region between the first indicator portion and the second indicator portion, and wherein a surface of the medium which is located on an opposite side of the medium from a surface thereof at which the indicator portion is provided comprises:

a portion located on an opposite side of the medium from the first indicator portion and opposed to the first outer surface; and a portion located on an opposite side of the medium from the second indicator portion and opposed to the second outer surface.

7. The cassette according to claim 6, wherein the first manner and the second manner are different from each other in direction as reference to the information.

8. The cassette according to claim 4, wherein the information comprises at least a character, and wherein the first manner and the second manner are different from each other in size of the character.

9. The cassette according to claim 2, wherein the half-cut line is one of:

a first half-cut line in which an entire cut portion cut across the medium in a thickness direction of a protruding portion of the medium protruding to an outside of the housing is formed at a portion of the medium in a widthwise direction of the protruding portion; and a second half-cut line in which a half-cut portion comprising a slit formed in a portion of the medium in the thickness direction of the protruding portion is formed in one of entirety and a portion of the medium in the widthwise direction of the protruding portion.

10. The cassette according to claim 1, wherein the information comprises at least gray-level information indicating a design in which a print density gradually changes.

11. The cassette according to claim 1, further comprising a storage configured to store at least a portion of the information.

12. The cassette according to claim 1, wherein the medium comprises a third indicator portion different from the indicator portion and provided at a portion of the medium which is different from a protruding portion of the medium protruding to an outside of the housing.

13. The cassette according to claim 1, wherein the housing contains a first roll that is a roll of a tape on which the information is to be printed, and wherein the medium comprises at least the tape.

14. The cassette according to claim 13, wherein the housing contains a second roll that is a roll of a film to be stuck to the tape on which the information is printed, and wherein the medium comprises the tape and the film.

15. A cassette body, comprising:

a cassette comprising (i) a housing and (ii) a medium contained in the housing and including a substrate and a release paper sheet stuck to the substrate, at least a portion of the substrate being contained in the housing, wherein the substrate includes an indicator portion on which information has already been printed, the information being information indicating at least one of (i) a width of the medium, (ii) an entire length of the medium and (iii) a cassette of type; and a bag configured to cover the cassette, wherein a portion of the bag which is opposed to the indicator portion has transparency or comprises a through hole.

16. The cassette according to claim 1, wherein the indicator portion on which the information has already been printed is located at a downstream side of a discharging portion of the housing from which the medium is discharged from the housing in a direction in which the medium is conveyed.

17. The cassette according to claim 1, wherein the indicator portion on which the information has already been printed is located at a downstream end side of the medium that is nearer to a downstream end of the medium than an upstream end of the medium in a direction in which the medium is conveyed.

* * * * *